US006786486B1

(12) United States Patent
Otremba

(10) Patent No.: US 6,786,486 B1
(45) Date of Patent: Sep. 7, 2004

(54) FISHING BOARD GAME

(76) Inventor: Paul M. Otremba, 14063 Jackson, Taylor, MI (US) 48180

( * ) Notice: Subject to any disclaimer, the term of this patent is extended or adjusted under 35 U.S.C. 154(b) by 0 days.

(21) Appl. No.: 10/704,771

(22) Filed: Nov. 10, 2003

(51) Int. Cl.[7] ..... A63F 3/00

(52) U.S. Cl. ..... 273/282.1; 273/244; 273/259; 273/145 C

(58) Field of Search ..... 273/244, 259, 273/277, 145 R, 145 C, 145 CA, 282.1, 282.2

(56) References Cited

U.S. PATENT DOCUMENTS

| | | | | | |
|---|---|---|---|---|---|
| 2,072,799 | A | * | 3/1937 | Creswell | 273/308 |
| 3,356,369 | A | * | 12/1967 | Stubbmann | 273/145 CA |
| 3,888,489 | A | * | 6/1975 | Kane | 273/244 |
| 3,921,981 | A | | 11/1975 | Ashburn | |
| 4,003,578 | A | * | 1/1977 | Jones | 273/244 |
| D292,105 | S | | 9/1987 | Aguirre | |
| 5,176,385 | A | | 1/1993 | Tagliaferro | |
| 5,186,466 | A | | 2/1993 | Mudd | |
| 5,513,848 | A | | 5/1996 | Keener | |
| 5,876,034 | A | * | 3/1999 | Stafford | 273/244 |
| 6,257,576 | B1 | | 7/2001 | Pontacoloni | |

FOREIGN PATENT DOCUMENTS

| | | | | |
|---|---|---|---|---|
| GB | 2123304 A | * | 2/1984 | A63F/3/00 |
| GB | 2195904 A | * | 4/1988 | A63F/3/00 |
| GB | 2288744 A | * | 11/1995 | A63F/3/00 |
| GB | 2368292 A | * | 5/2002 | A63F/3/00 |

* cited by examiner

*Primary Examiner*—Derris H. Banks
*Assistant Examiner*—Urszula Cegielnik
(74) *Attorney, Agent, or Firm*—Gregory T. Zalecki

(57) ABSTRACT

A fishing board game comprising a gameboard, fish cards, color cards, bait boards, playing cards, game pieces and a pair of dice. The gameboard comprises a circuitous grid of interconnected fishing points, a portion of which are designated by color as fishing holes where fish may be caught. A fish card identifies a player's target fish which, if caught, increases the points associated with the catch. The color cards assign a point value to a catch which varies depending upon whether the player has selected an appropriate bait on the player's bait board. The playing cards are used to catch a fish, impair an opponent or assist a player. The dice are used to determine the number of spaces which a player may move and for generating random numbers required by the game rules.

12 Claims, 5 Drawing Sheets

102,106,130
PREMIUM LICENSE 108,130
GAME WARDEN 110,112,130
LIVE BAIT 110,114,130
ARTIFICIAL LURES 110,116,130
FLY ROD 110,118,130
TROLLING MOTOR 120,122,130
LOST BAIT 120,124,130
MISSING LURES 120,126,130
BROKEN FLY-ROD 120,128,130
DEAD TROLLING MOTOR 130,132
MASTER ANGLER 130,134
FISHING GUIDE

FISHING BOARD GAME

BACKGROUND

Many types of board games exist. They are generally entertaining and occasionally serve to teach the players. A number of fishing board games exist. These games are typically entertaining. However, they do little to teach a novice fishermen the skills necessary to become an expert veteran fisherman.

The prior art discloses numerous fishing board games. These include U.S. Pat. Nos. 3,921,981, 5,176,385, 5,186,466, Des. 292,105, 5,513,848 and 6,257,576.

There is a need for an improved fishing board game which is entertaining and educational for the players. The game should teach the players how to identify various types of fish; the types of food which the various types of fish feed upon; how the various types of fish are rated by desirability by veteran fishermen; and where environmentally the various types of fish may be found.

SUMMARY

The present invention is directed to a fishing board game which satisfies these needs.

The fishing board game is comprised of a gameboard, a plurality of fish cards, a plurality of colored color cards, a plurality of bait boards and a plurality of playing cards.

The gameboard has a starting area. This is where the players place game pieces assigned to each of them prior to the start of the game. A circuitous grid of interconnected fishing points begins and ends at the starting area. The grid is comprised of intersecting lines. Each line intersection is a fishing point. A portion of the fishing points are designated by color as fishing holes. To designate a fishing hole, a circle is placed around the intersecting lines and filled with a color. During the playing of the game fish are located within the fishing holes.

Preferably, the gameboard is also comprised of a plurality of color card slots, a fish card slot, a playing card draw slot, a playing card discard slot and a dice bubble. The color card slot holds color cards. The fish card slot holds fish cards. The playing card draw slot holds unplayed playing cards. The playing card discard slot holds discarded playing cards. The dice bubble encloses a pair of dice. The dice bubble is a traditional dice bubble which causes the enclosed dice to be randomly rolled when the bubble is pushed upon. The number resulting from a roll of the dice is used to determine the number of fishing points to be traversed by a player and for generating random numbers required by the rules of the game.

The fish cards have a uniform appearance on one side. The other side of each fish card designates a unique fish. That fish identifies a target fish for a player. When a player catches a target fish, the points assigned to that catch are enhanced.

The colors of the color cards are comprised of the colors assigned to the fishing holes. Each fishing hole color can be found as a matching color on a plurality of color cards. The primary purpose of the color cards is to set a point value when a fish is caught. Each color card has a plurality of bait designator, fish and point combinations listed thereon. Each color card also has a fish and point combination which is not associated with a bait designator. When a fish is caught, the game rules require a determination of whether the bait designator on a selected color card matches a selected bait designator on a player's bait board. When such a match occurs the player is awarded the points associated with the color card bait designator which matches the selected bait board bait designator. If there is no such match after a fish catch, the player is assigned the points associated with the fish and point combination on the color card which are not associated with a bait designator.

During the playing of the game each player is assigned a bait board. Each bait board has a plurality of labeled grouped baits. One label applies to each group of baits. Each bait within a group of baits is associated with a bait designator. The bait designator on the bait board associates a selected bait on the bait board with fish and point combinations listed on the color cards. Each bait within within the grouped baits on the bait board is also associated with a bait selector. The bait selector is used by a player to select a bait on the player's bait board. Preferably, the bait selector is comprised of a peg and a hole wherein the hole is associated with a specific bait on the bait board. A bait on a bait board is selected by placing the peg in a hole associated with the desired bait.

The playing cards are comprised of sequential fishing cards. Preferably, the playing cards are also comprised of specialty cards and snag cards. Preferably, the sequential fishing cards are comprised of cast cards, bite cards, hook cards, fight cards and caught cards. The rules of the game require that one of each type of sequential fishing card be played, in order, for a player to catch a fish.

The specialty cards are comprised of game warden cards, fishing license cards, bonus bait cards and bogus bait cards. The game warden cards are used to impair an opponent's ability to accumulate points. The fishing license cards are used for neutralizing the game warden cards. The bonus bait cards are used to permit a player to select an additional bait on the bait board assigned to that player. The bogus bait cards are used to inhibit an opponent's ability to select baits from within a bait group on the opponent's assigned bait board. The snag cards are used to impair an opponent's ability to catch fish.

In the preferred embodiment of this invention the fish associated with each bait designator, fish and point combination on the color cards of each color is selected from a group of fish having similar desirability (as determined by the typical fisherman) and preferred foods.

The game pieces are used to designate each player's position on the gameboard.

DRAWINGS

These and other features, aspects, and advantages of the present invention will become better understood with regard to the following description, appended claims, and accompanying drawings where:

FIG. 1 is a perspective view of the fishing gameboard showing the circuitous grid of interconnected fishing points, the colored fishing holes, the starting area, the color card slots, the fish card slot, the playing card draw slot, the playing card discard slot, the dice bubble and a pair of dice.

FIG. 2*a* is a perspective view showing one side of a fish card.

FIG. 2*b* is a perspective view showing the other side of a series of fish cards.

Figure 5A:
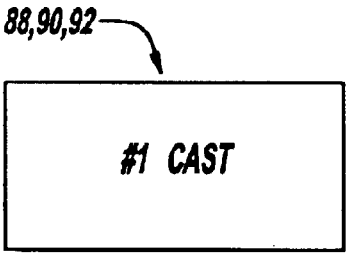
Figure 5B:
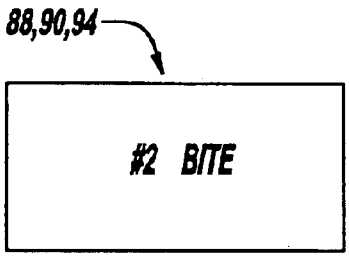
Figure 5C:
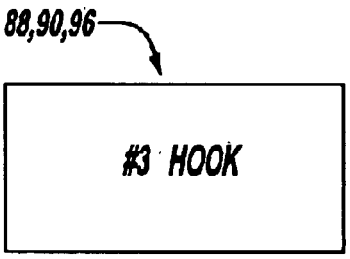
Figure 5D:
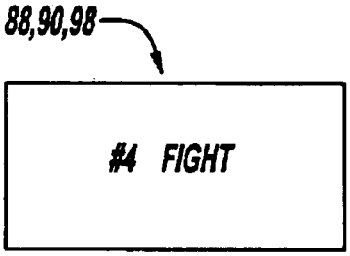
Figure 5E:
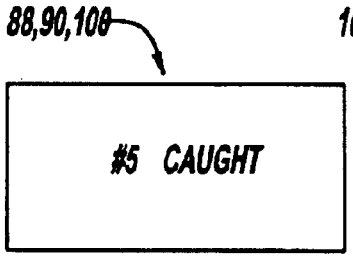
Figure 5F:
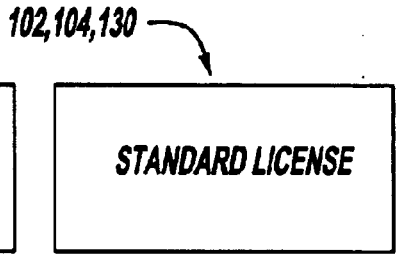
Figures 5G, 5H, 5I, 5J, 5K, 5L, 5M, 5N, 5O, 5P, 5Q, 5R:
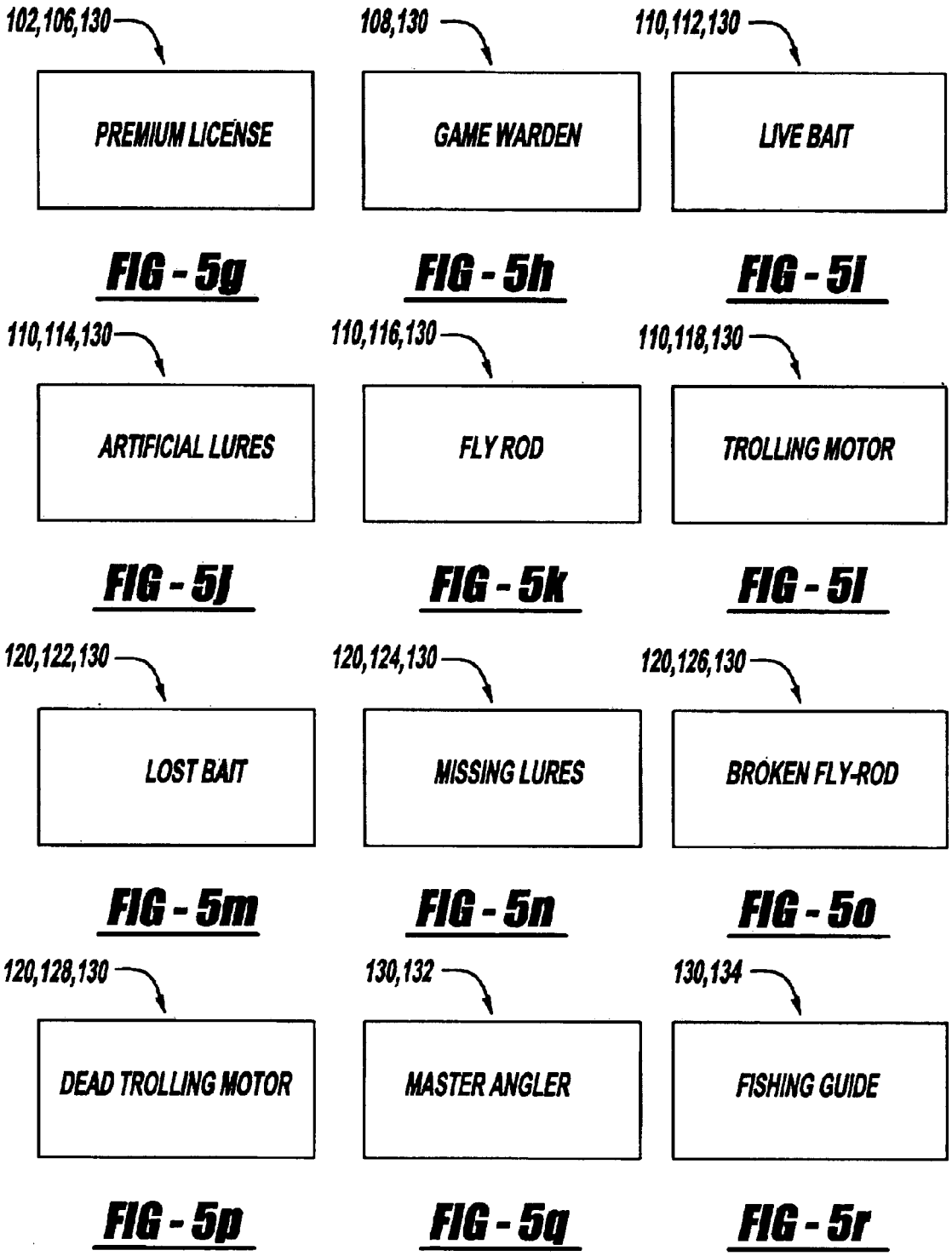
Figure 5S:
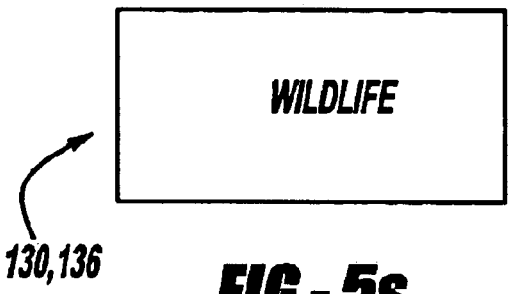
Figure 5T:
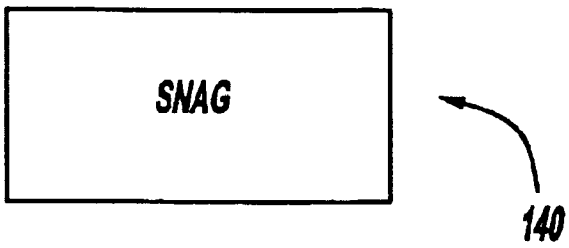

FIG. 5*a*–FIG. 5*t* are top views of playing cards.

Figure 6:
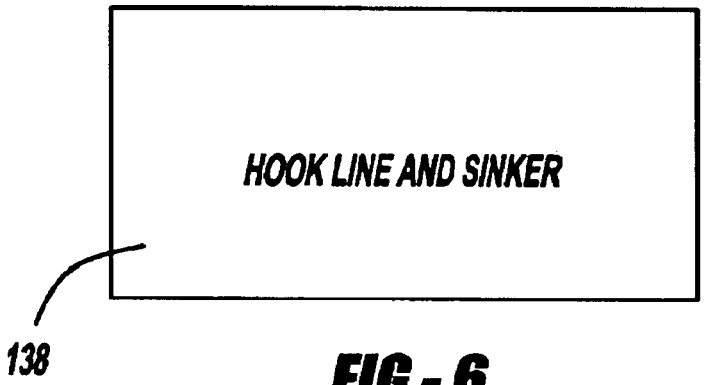

FIG. 6 is a top few of the other side of a playing card.

DESCRIPTION

The preferred embodiment of the fishing board game is comprised of a game board 30, fish cards 64, colored color cards 72, bait boards 50, playing cards 88, game pieces 142 and a pair of dice 47.

The game board 30 has a starting area 32 centered along its left edge. This provides an area for the placement of game pieces 142 for each player prior to the beginning of a game. A circuitous grid of interconnected fishing points 34 begins and ends at the starting area 32. During the playing of the game the game pieces 142 are moved from grid 34 intersection to grid 34 intersection in accordance with the results of a roll of the dice 47. A portion of the grid 34 intersections are designated by color as fishing holes 36. Preferably there are from 50 to 100 fishing holes 36 with each fishing hole 36 being colored white, brown, green, yellow, red, blue or black. Fish are located at the colored fishing holes 36. Preferably, contiguous groups of fishing holes 36 have the same color. Grid 34 intersections which do not have colored fishing holes 36 contain no fish. Alternatively, fishing holes 36 without fish could be denoted as black fishing holes 36.

Figure 1:
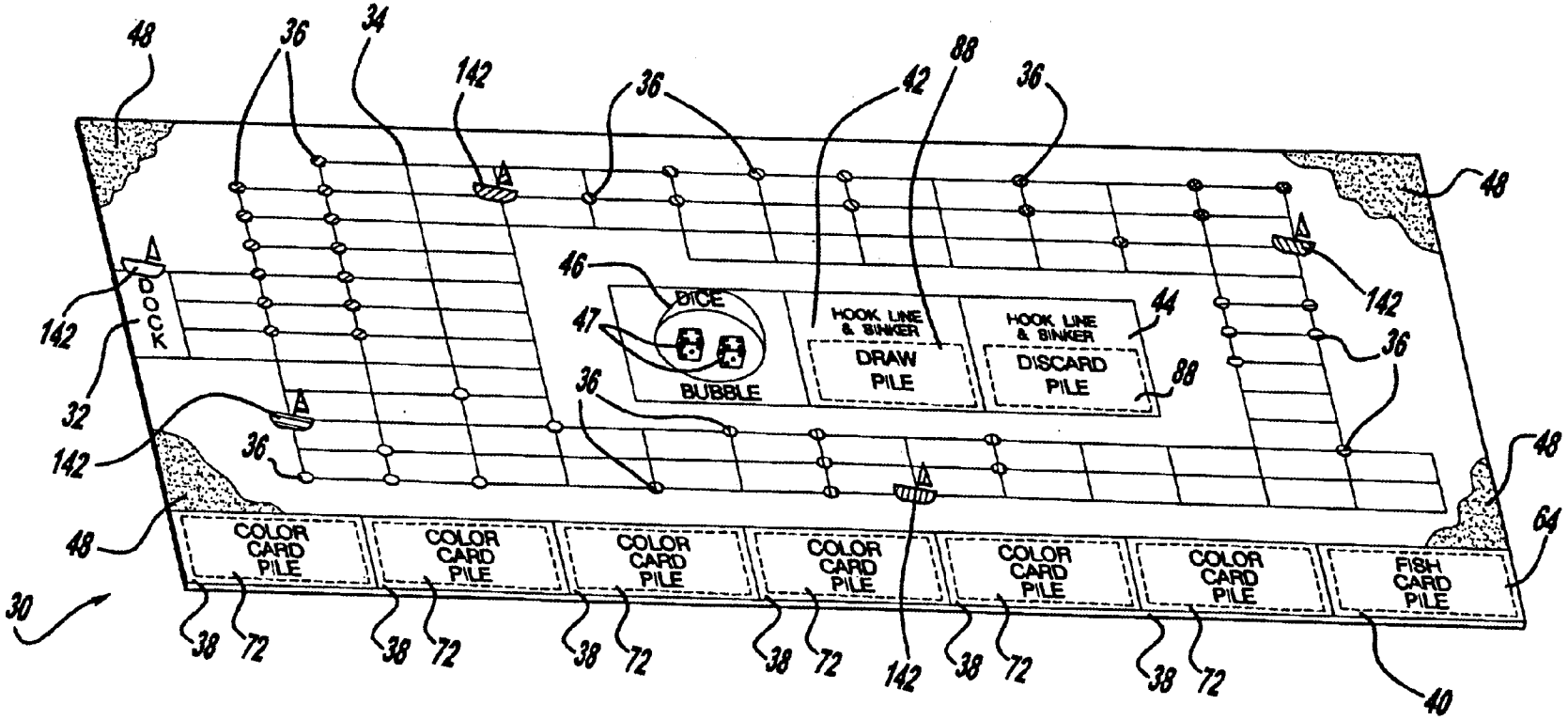

Six color card slots 38 are positioned along the bottom of the gameboard 30 and aligned to the left edge of the gameboard 30, as shown in FIG. 1. The color card slots 38 are sized to receive and hold a set of color cards 72. A fish card slot 40 is positioned along the bottom of the gameboard 30 and aligned to the right edge of the gameboard 30, as shown in FIG. 1. The fish card slot 40 is sized to receive and hold a set of fish cards 64.

A dice bubble 46, a playing card draw slot 42 and a playing card discard slot 44 are positioned within the center of the gameboard 30 so as not to interfere or overlap with the circuitous grid 34, as shown in FIG. 1. The dice bubble 46 contains, and enables the random rolling of, the pair of dice 47. Because the dice 47 are contained within the bubble 46, the dice 47 will not cause unintended movement of game pieces 142, fish cards 64, color cards 72, or playing cards 88. The playing card draw slot 42 and the playing card discard slot 44 are sized to receive and hold a set of playing cards 88. The playing card draw slot 42 holds unplayed playing cards 88. The playing card discard slot 44 holds played playing cards 88.

Preferably, the gameboard 30 has an aquatic background 48. Different aquatic backgrounds 48 may also be associated with groups of fishing holes 36. Such backgrounds may include deep lakes, strong running rivers, swamps and marshes. This will permit the game to be used as a teaching tool for novice fishermen. The novice fisherman can be taught where to fish for certain types of fish by associating those types of fish with aquatic backgrounds 48 and colored fishing holes 36 appropriate for that certain type of fish.

Figure 2A:
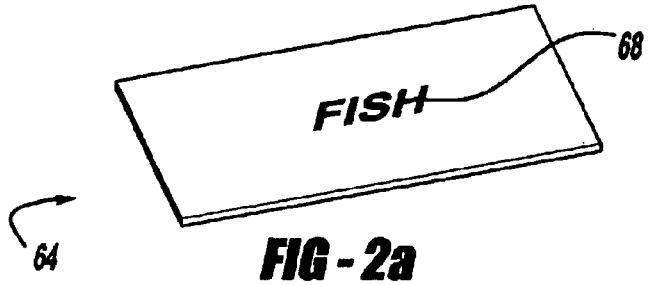
Figure 2B:
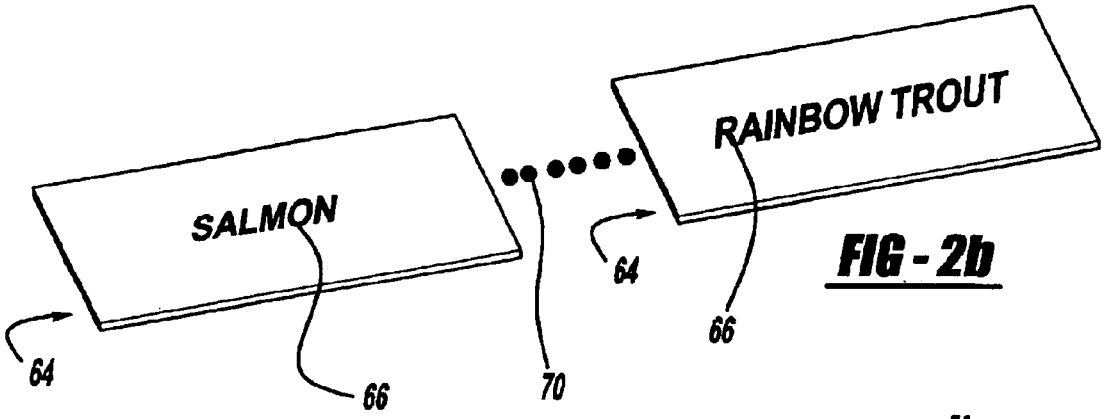

FIG. 2*a* and FIG. 2*b* show a series 70 of fish cards 64. One side 68 of the fish cards 64 shows the word FISH. The other side of each fish card 64 shows a unique fish 66. Preferably, there are 18 fish cards 64. The fish come from four groups. The groups are panfish, rough fish, standard fish and premium fish. The panfish fish cards 64 are labeled bluegill, rock bass, crappie and yellow perch. The rough fish fish cards 64 are labeled bullhead, sucker, carp and catfish. The standard fish fish cards 64 are labeled largemouth bass, smallmouth bass, pike, walleye and muskellunge. The premium fish fish cards 64 are labeled brooktrout, rainbow trout, brown trout, steelhead and salmon.

Figure 4:
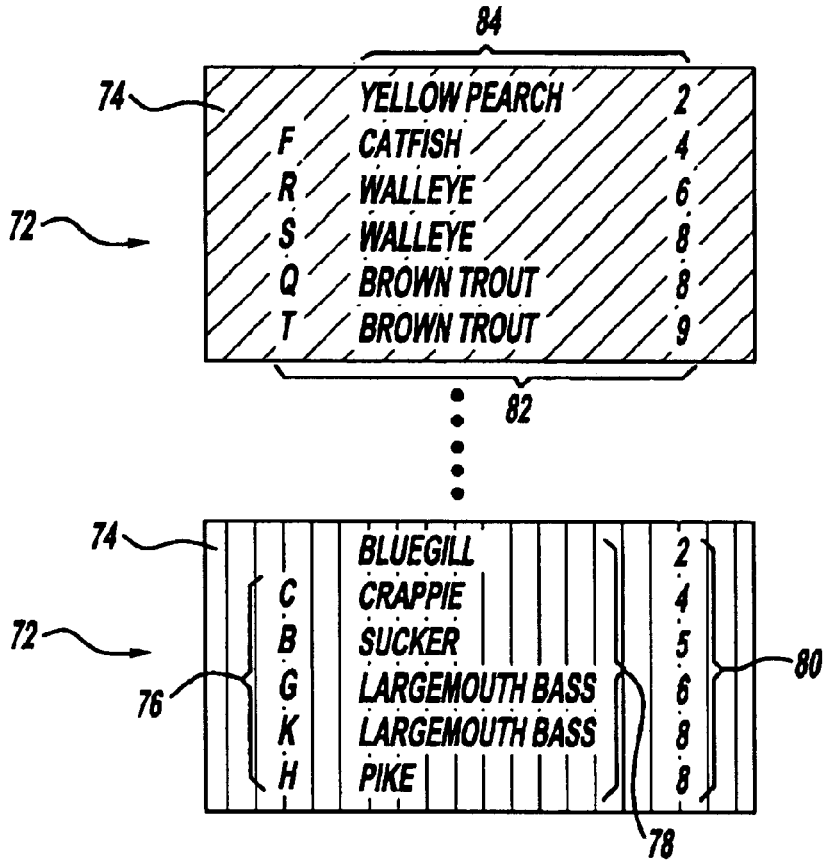
FIG. 4 is a top view of a series of color cards.

FIG. 4 shows a series of colored color cards 72. Each color card 72 has a base color 74. The base colors 74 are selected from the group of colors comprising the colors of the colored fishing holes 36. Each fishing hole 36 color coincides with the base color 74 of a plurality of colored color cards 72. Each colored color card 72 contains a plurality of bait designator 76, fish 78 and point 80 combinations 82. Each bait designator 76 on the color cards 72 is a capital letter. It refers to a bait designator 56 located upon the bait board 50. The bait designator 76 allows a fish bait to be identified by a letter. Each fish 78 on a color card 72 is a potential fish to be caught during the playing of the game. The point value 80 across from that fish is the point value assigned if the fish is caught. Each horizontal combination 82 of a bait designator 76, a fish 78 and a point value 80 identifies a potential fish to be caught by a specific bait and the point value 80 to be assigned to that catch. Each color card 72 also contains one fish and point combination 84 not associated with a bait. There will be times when a fish is caught, but with the wrong bait. During the playing of the game a player selects a bait on his bait board 50. Each fish catch is associated with a single color card 72. If the color card 72 associated with that fish catch does not contain a bait designator 76 coinciding with a bait selected by the player on his or her bait board 50, then the fish is caught with the wrong bait. When this contingency occurs the point value assigned to the catch is the point value 80 assigned to the fish and point combination 84 not associated with a bait designator.

Preferably, there are 60 color cards 72—ten for each color except black. The point values 80 associated with each fish on the color cards 72 should be as follows: bluegill (1–3), rock bass (1–3), crappie (2–4), yellow perch (2–4), bullhead (2–4), sucker (2–4), carp (3–5), catfish (3–5), largemouth bass (6–8), smallmouth bass (6–8), pike (6–8), walleye (6–8), muskellunge (6–8), brooktrout (7–9), rainbow trout (7–9), brown trout (7–9), steelhead (9–10) and salmon (10). This association of point values 80 with various fish 78 on the color cards 72 is consistent with the relative desirability of each fish 78 generally accepted by most fishermen. Alternatively, the game may include a fish chart. The fish chart would identify the type of fish within each colored fishing hole. Additionally, it would show the preferred baits for each fish. This would help educate the novice fishermen regarding the environment preferred by various types of fish, as well as the baits preferred by various types of fish.

Figure 3:
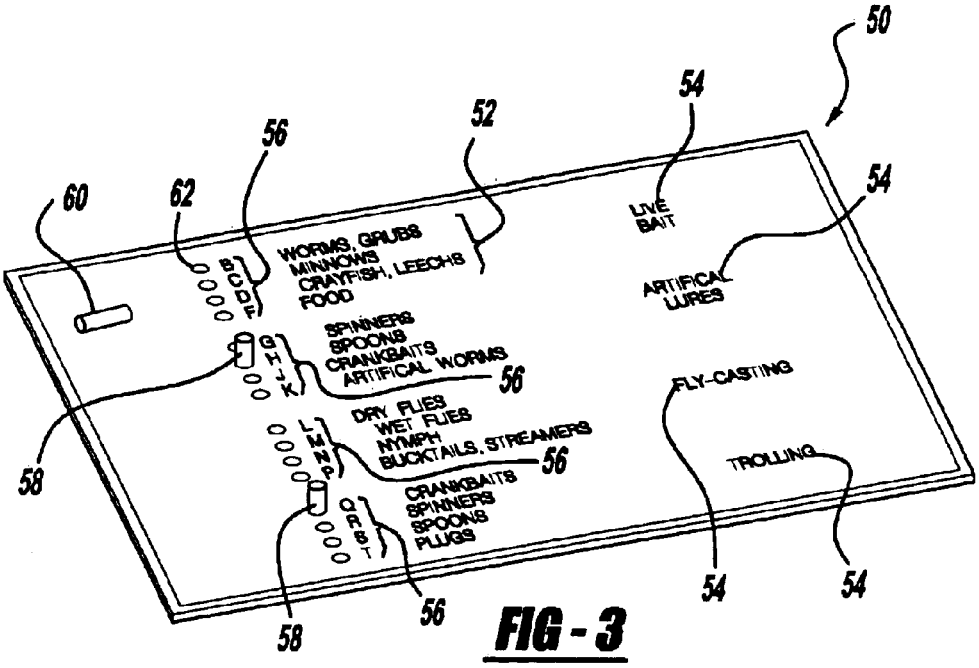
FIG. 3 is a top view of a bait board.

As can be seen from FIG. 3, the baits 52 are grouped and labeled 54. For example, the live bait group consists of worms, grubbs, minnows, crayfish, leeches and food. The other bait groups 54 are artificial lures, flycasting and trolling. Each fish has a tendency to prefer one bait group. Certain groups of fish have similar feeding preferences. It is invaluable for a fisherman to know the feeding preferences of the fish he or she desires to catch. An expert fisherman is able to rate the likelihood of catching a certain fish type with a certain bait group as poor, fair, good or excellent. By grouping fish with similar feeding preferences and baits together on the same color of color card 72 the novice fisherman can be taught the feeding preferences of various fish. Further, such grouping will enhance the realism of the game. Additionally, there is a correlation between the average fisherman's rating of the desirability of certain fish and the bait groups preferred by those fish. Accordingly, the bait designator 76, fish 78 and point value 80 combinations 82 should be consistent with the following, although such consistency is not a necessary element of this invention.

The white color cards 72 should contain bluegill, rock bass, crappie, bullhead and largemouth bass. The bait designator 76, fish 78 and point value 80 combinations 82 should be consistent with the following bait group evaluations: live bait-excellent, artificial lures-good, trolling-poor and flycasting-fair.

The brown color cards 72 should contain rock bass, bullhead, sucker, carp and pike. The bait designator 76, fish 78 and point value 80 combinations 82 should be consistent with the following bait group evaluations: live bait-excellent, artificial lures-fair, trolling-poor and flycasting-poor.

The green color cards 72 should contain bluegill, sucker, crappie, largemouth bass, pike, muskellunge and carp. The bait designator 76, fish 78 and point value 80 combinations 82 should be consistent with the following bait group evaluations: live bait-good, artificial lures-excellent, trolling-fair and flycasting-fair.

The yellow color cards 72 should contain perch, catfish, smallmouth bass, walleye, muskellunge, rainbow trout and brooktrout. The bait designator 76, fish 78 and point value 80 combinations 82 should be consistent with the following bait group evaluations: live bait-fair, artificial lures-fair, trolling-excellent and flycasting-poor.

The red color cards 72 should contain bluegill, smallmouth bass, brooktrout, rainbow trout and salmon. The bait designator 76, fish 78 and point value 80 combinations 82 should be consistent with the following bait group evaluations: live bait-fair, artificial lures-fair, trolling-poor and flycasting-excellent.

The blue color cards 72 should contain perch, catfish, walleye, muskellunge, brooktrout, brown trout and steelhead. The bait designator 76, fish 78 and point value 80 combinations 82 should be consistent with the following bait group evaluations: live bait-fair, artificial lures-fair, trolling-good and flycasting-good.

The progression from white to blue indicated above also correlates with an increase in desirability of the fish contained within those colors. Therefore, the average point values associated with the fish listed on the color cards should progress from lower point values on the yellow color cards 72 to higher point values on the blue color cards 72.

During the playing of the game one bait board 50, as shown in FIG. 3, is assigned to each player. The bait board 50 contains four sets of grouped baits 52. For example, the second set of grouped baits 52 consists of spinners, spoons, crank baits and artificial worms. Each set of grouped baits 52 is associated with a bait group label 54. The bait group label 54 for the set of grouped baits 52 consisting of spinners, spoons, crank baits and artificial worms is "Artificial Lures." Each bait within the grouped baits 52 is associated with a bait designator 56. The bait designator 56 is a single capital letter identifying the bait. The bait designator 56 on the bait board 50 is the same capital letter as the bait designator 76 on a color card 72 when the bait referred to on the bait board 50 is identical to the bait referred to on the color card 72. A bait from within the grouped baits 52 on a bait board 50 is selected by a player by using a bait selector 58. A bait selector 58 is associated with each bait on a bait board 50. A hole 62 is associated with each bait designator 56 on each bait board 50 by placing the hole 62 adjacent to the bait designator 56, as shown in FIG. 3. A specific bait is selected by a player by placing a peg 60 within the desired hole 62. Thus, a bait selector 58 for a selected bait is comprised of a hole 62 and a peg 60. The bait board 50 may be shaped as a tackle box and may contain graphical depictions of the baits to enhance the realism of the game and to teach a novice fishermen how to identify various baits.

The playing cards 88 are comprised of sequential fishing cards 90, snag cards 140 and specialty cards 130. The reverse side 138 of each playing card 88 has an identical appearance as shown in FIG. 6. There the reverse side 138 is labeled "HOOK LINE AND SINKER." The specialty cards 130 are comprised of game warden cards 108, fishing license cards 102, master angler cards 132, fishing guide cards 134, wildlife cards 136, bonus bait cards 110 and bogus bait cards 120. The game may be played without snag cards 140 and specialty cards 130. However, snag cards 140 and specialty cards 130 are used in the preferred embodiment of the game.

The sequential fishing cards 90 are used to catch fish. Preferably, the sequential fishing cards 90 are comprised of cards labeled as follows: #1 CAST 92, #2 BITE 94, #3 HOOK 96, #4 FIGHT 98 and #5 CAUGHT 100. The playing time of the game may be shortened or lengthened by decreasing or increasing the types of sequential fishing cards 90, respectively.

Snag cards 140 are labeled "SNAG."

The game warden cards 108 are labeled "GAME WARDEN." There are two types of fishing license cards 102. The first is a standard fishing license card 104 labeled "STANDARD LICENSE." The second is a premium fishing license card 106 labeled "PREMIUM LICENSE." There are four types of bonus bait cards 110—"LIVE BAIT" 112, "ARTIFICIAL LURES 114, "FLY ROD" 116 and "TROLLING MOTOR" 118. There are four types of bogus bait cards 120—"LOST BAIT" 122, "MISSING LURES" 124, "BROKEN FLY-ROD" 126 and "DEAD TROLLING MOTOR" 128. Additionally, there are playing cards 88 labeled "MASTER ANGLER" 132, "FISHING GUIDE" 134 and "WILDLIFE" 136.

Preferably, there are 118 playing cards 88 broken down as follows: #1 CAST 92-16, #2 BITE 94-16, #3 HOOK 96-16, #4 FIGHT 98-16, #5 CAUGHT 100-16, SNAG 140-6, GAME WARDEN 108-6, STANDARD LICENSE 104-6, PREMIUM LICENSE 106-6, MASTER ANGLER 132-2, FISHING GUIDE 134-2, WILDLIFE 136-2, LIVE BAIT 112-1, ARTIFICIAL LURES 114-1, FLY ROD 116-1, TROLLING MOTOR 118-1, LOST BAIT 122-1, MISSING LURES 124-1, BROKEN FLY-ROD 126-1 and DEAD TROLLING MOTOR 128-1.

A plurality of game pieces 142 are shaped, sized and colored to uniquely identify each player, fit on the gameboard 30, designate only one fishing point on the circuitous grid of interconnected fishing points 34 at a time and designate a player's position on the gameboard 30.

The object of the game is to catch 100 points worth of fish. The game is completed when a player attains 100 points and returns to the starting area 32. Alternatively, after a first player attains 100 points play continues until each player has completed the same number of turns as the player that first attained the 100 points. The winner is the player with the most points. GAME SET UP The first step to play the game is to set the game up. The gameboard 30 is placed upon a table. The fish cards 64 are shuffled and placed faced down upon the fish card slot 40. The color cards 12 are mixed and shuffled. They are equally distributed and placed faced down upon the color card slots 38. Preferably, the number of color card slots 38 used is equal to the number of players. Therefore, if there are less than six players, less than six color card slots 38 will be used. A random mixture of colors 74 will be placed upon each color card slot 38 which is used. The playing cards 88 are mixed and shuffled. They are then placed faced down upon the playing card draw slot 42. Each player places a game piece 142 assigned to that player within the starting area 32 of the gameboard 30. As can be seen from FIG. 1 the starting area 32 has multiple starting points. Each player can use any starting point as his or her starting point. Finally, a bait board 50 is assigned to each player.

Pre Start Procedure

Six playing cards 88 are dealt face down to each player. One fish card 64 is dealt face up to each player. Each player's fish card 64 identifies a target fish. If a target fish is caught the points associated with that catch, as indicated on a color card 72, are doubled. The fish cards 64 drawn by the players at the outset of the game determine which player starts. The player with the highest valued fish card 64 starts. The fish cards 64 are valued from lowest to highest as follows: bluegill, rock bass, crappie, yellow perch, bullhead, sucker, carp, catfish, largemouth bass, smallmouth bass, pike, walleye, muskellunge, brooktrout, rainbow trout, brown trout, steelhead and salmon. The playing order for the remaining players proceeds counterclockwise from the starting player.

Rules of the Game

A player may pick a bait on his bait board 50 before his turn starts or after his turn stops. Except as otherwise described herein, a bait may not be selected during a player's turn. A bait is selected by placing a peg 60 into one of the holes 62 on the player's bait board 50. A peg 60 in a hole 62 designates the bait designator 56 and bait positioned horizontally across from the peg on the bait board 50.

With a bait selected a player executes his turn by first rolling the dice 47. The dice 47 are rolled by pushing upon the dice bubble 46. The number indicated by the dice 47 sets the maximum number of fishing points upon the circuitous grid of interconnected fishing points 34 that the player can move. For example, if a seven is rolled a player can move from one to seven fishing points. A player may move from fishing point to fishing point horizontally or vertically, but not diagonally. A player must move around, and not over, the game pieces 142 of other players. No two game pieces 142 can occupy the same fishing point at the same time.

Fish are located under the colored fishing holes 36. On any given turn a player may move his game piece 142, as described above, or fish. A player may not do both during the same turn. Once a player's game piece 142 is on a fishing hole 36 and the fish are biting, the player may start fishing. The fish are biting when the color of the fishing hole 36 upon which a player's game piece 142 sits is the same color 74 as at least one of the top color cards 72 placed upon the color card slots 38 of the gameboard 30.

When a player elects to fish the player's turn is concluded by catching a fish or playing a playing card 88 other than a sequential fishing card 90. A player fishes by drawing a playing card 88 from the playing card draw slot 42. After drawing a playing card 88 the player must discard a playing card 88. There are several ways to discard. The playing card 88 may be discarded face down into the playing card discard slot 44. Certain playing cards 88 may be played upon an opponent by placing the playing card 88 in front of the opponent. Other playing cards 88 may be played by the player upon himself. The playing cards 88 which may be played upon an opponent or upon the player himself are described below.

The sequential fishing cards 90 are used to catch a fish. The sequential fishing cards 90 are comprised of cast cards 92, bite cards 94, hook cards 96, fight cards 98 and caught cards 100. The sequential playing cards 90 must be played in the order stated. Thus, the order of play is cast, bite, hook, fight and caught. Sequential fishing cards 90 may be continuously played during a turn until a break in the sequence occurrs. The optimum sequence is called a perfect run and occurs as follows. A player plays a cast card 92 in front of the player and draws another playing card 88. Following this the player plays a bite card 94 and draws again. Then the player plays a hook card 96 and draws. This sequence continues with the player playing the fight card 98 and the caught card 100. If the player is unable to continue the sequence because the player lacks the next sequential fishing card 90 the player's turn ends. However, the sequential fishing cards 90 previously played remain in front of the player and arc not discarded. If a player is ever on a fishing hole 36 when the fish are not biting (the color of the fishing hole 36 does not match the color 74 of any color card 72 on the top of a color card pile located upon a color card slot 38), the player must discard all of the player's sequential fishing cards 90. All other cards which have been played in front of the player remain. This loss of sequential playing cards 90 only occurs during the player's turn.

A fish is caught when the caught card 100 is played. The caught card 100 cannot be played until a cast card 92, a bite card 94, a hook card 96 and a fight card 98 have been played in order in front of the player. When a fish is caught, the player catching the fish selects a color card 72 from one of the color card slots 38. The color 74 of the color card 72 must match the color of the fishing hole 36 upon which the player's game piece 142 sits. If the bait selector 58 shows a match between the bait designator 56 on the player's bait board 50 and the bait designator 76 on the selected color card 72, the player is awarded the points indicated by the bait designator 76, fish 78 and point value 80 combination 82 on the selected color card 72. If there is no bait match, the player is awarded the points indicated by the fish and point combination not associated with a bait 84. If the fish caught matches the fish indicated by the player's fish card 64, the points awarded are doubled.

Once a fish is caught the player discards all playing cards 88 in front of the player and discards the player's fish card 64. A new fish card 64 is drawn from the fish card slot 40. At the conclusion of a player's turn, the player will have six playing cards 88 irrespective of whether or not the player is involved in making a run by playing sequential fishing cards 90 or plays a single playing card 88 elsewhere.

Fishing license cards 102 protect a player from game wardens. Game warden cards 108 are given to opposing players by playing the game warden card 108 in front of the opponent. A player plays a fishing license card 102 on himself or herself. The penalty for catching a fish with the game warden card 108 present is termed a "weigh in". Standard fishing license cards 104 protect standard fish species only. Premium fishing license cards 106 protect standard and premium fish species. Panfish and rough fish do not need to be protected from game wardens. If there is no game warden present on the catch, then there is no "weigh in." The only time that a "weigh in" occurs is when a game warden is present and the player does not have the proper license.

To conduct a "weigh in" a player rolls the dice 47. The number rolled must match or be higher than the point value of the fish. If it is lower than the point value, then the angler must take the dice roll value as the player's points. The following table shows the value of points awarded for various dice rolls and fish point values 80:

| Dice Roll | Fish Point Value | Player's awarded points after "weigh in" |
|---|---|---|
| 2 | 7 | 2 |
| 4 | 8 | 4 |
| 6 | 6 | 6 |
| 9 | 8 | 8 |
| 11 | 7 | 7 |

If a player's catch is worth 8 points, then the player must roll an 8 or higher. If the player rolls lower than an 8, the player collects the dice roll value as a penalty.

Bogus bait cards 120 are given to an opponent, while bonus bait cards 110 are played in front of the player playing the card. When a bonus bait card 110 has been played, the player can play two baits on the player's bait board 50. However, one of the baits must be from the group of baits associated with that bonus bait card 110. The groupings are shown on the bait board 50 by the bait group label 54. For example, the bait group label 54 "trolling" on the bait board 50 indicates the following baits: crankbaits, spinners, spoons and plugs. Therefore, if a player plays the trolling motor bonus bait card 118 in front of the player, the player may select one of the following as the player's second bait on the player's bait board 50: crankbaits, spinners, spoons and plugs.

When a bogus bait card 120 has been played on a player by an opponent, the player cannot use bait from that group. For example, if the "dead trolling motor" bogus bait card 128 has been played in front of a player, the player may not select crankbaits, spinners, spoons or plugs as the player's bait on the player's bait board 50. If a player happens to have both related bait cards (i.e. live bait 112 and lost 122), those cards simply offset each other. The offsetting cards are not discarded.

A master angler card 132 may be played in front of a player. This gives a player two advantages. The player can discard any playing cards 88 which have been played in front of the player, with the exception of the snag card 140. If a player having a master angler card 132 in front of the player is snagged by an opponent playing a snag card 140 in front of the player, the player is given two dice rolls, instead of one, when determining the player's snag fate as described below. The player may pick the better of the two rolls.

A player may play a fishing guide card 134 in front of the player to determine what fish are biting. When this card is played, the player can look at all top color cards 72 which match the color of the player's fishing hole 36. Therefore, the player will know in advance the possible fish 78, bait designator 76 and point value 80 combinations 82 which may result from a catch. The player can look at the color cards 72 after the card is played and before every future turn, as long as the fishing guide card 134 remains showing.

After a player plays a wildlife card 136 in front of himself or herself, the player may pick any available target fish. This is accomplished by the player looking at all fish cards 64 within the fish card slot 40 and selecting a desired fish card 64. The player's prior fish card 64 is discarded.

Snag cards 140 are given to a player's opponent. They may only be played on a player's sequential fishing card 90 pile. If an opposing player is moving or does not have a sequential fishing card 90 showing, then the snag card 140 may not be played on that player. One sure way of avoiding a snag is for a player to make a perfect run. A perfect run occurs when a player plays a cast card 92, a bite card 94, a hook card 96, a fight card 98 and a caught card 100 during one turn. If a player docs get snagged, when it comes around to the player's turn the player rolls the dice 47 to determine the player's fate. The players fate is determined as follows:

| Dice Roll | Fishing fate |
|---|---|
| 2 | Accident. Lose all cards 88. Move boat to dock (starting area 32). |
| 3 | Snagged weeds. Lose all cards 88. Move boat off of fishing hole 36 to nearest fishing point which is not a fishing hole 36. |
| 4 | Caught turtle. Lose all cards 88. |
| 5 | Unlawful fishing. Lose fishing license 102. |
| 6 | Snap! Lost it. Lose sequential fishing cards 90. |
| 7 | Roll again. |
| 8 | Broke free. Loss snag card 140. |

-continued

| Dice Roll | Fishing fate |
|---|---|
| 9 | The fish is still on. Lose snag card 140 and take your turn. |
| 10 | Caught the fish. |
| 11 | Caught trophy (target) fish. |
| 12 | Master angler trophy fish (equivalent to playing a master angler card and catching a trophy (target) fish). |

Game Variations

The gameboard 30 may be constructed so that it contains a crank. The turning of the crank would change the colors and locations of the fishing holes 36. Some color cards 72 would indicate "Fish Movement." If a fish is caught with such a color card 72, the crank would be turned to change the colors and locations of the fishing holes 36.

Another variation of the game involves the determination of the number of points awarded for catching a target panfish. This would occur when a player catches a panfish which matches the player's fish card 64. Instead of doubling the point value for catching the target fish, the player gets a stringer of fish. If a player were to catch a target bluegill, the player would be awarded the point value for that fish plus all other bluegill on that particular color card 72. For example, a player may catch a fish with a white color card 72 having the following bait designator 76, fish 78 and point value 80 combinations 82:

| | | |
|---|---|---|
| | Bluegill | 1 |
| L | Bluegill | 2 |
| F | Bluegill | 3 |
| C | Crappie | 3 |
| B | Crappie | 3 |

If the player's target fish were a crappie, the player would be awarded six points. If the player's target fish were a bluegill, the player would be awarded six points. The stringer rule would be good for panfish only.

What is claimed is:

1. A fishing board game comprising:

(a) a game board having a starting area and a circuitous grid of interconnected fishing points, a portion of which fishing points are designated by color as fishing holes, said grid beginning and ending at the starting area;

(b) a plurality of fish cards, each said fish card designating a fish, for identifying a player's target fish and enhancing points associated with that fish on color cards;

(c) a plurality of colored color cards, each said color card having a plurality of bait designator, fish and point combinations and each said color card having a fish and point combination not associated with a bait designator;

(d) a plurality of bait boards for assignment to players, each said bait board having a plurality of labeled grouped baits, each said bait within said grouped baits being associated with a bait designator for associating the bait with fish and point combinations on the color cards and each said bait within said grouped baits being associated with a bait selector for selecting the bait on the bait board; and (e) a plurality of playing cards comprising sequential fishing cards for catching a fish designated on a color card.

2. The fishing board game of claim 1, wherein the sequential fishing cards are comprised of cast cards, bite cards, hook cards, fight cards and caught cards.

3. The fishing board game of claim 1, wherein the fish associated with each bait designator, fish and point combination on the color cards of each color is selected from a group of fish having similar desirability and preferred foods.

4. The fishing board game of claim 2, wherein the fish associated with each bait designator, fish and point combination on the color cards of each color is selected from a group of fish having similar desirability and preferred foods.

5. A fishing board game comprising:

(a) a game board having a starting area, a circuitous grid of interconnected fishing points, a portion of which fishing points are designated by color as fishing holes, said grid beginning and ending at the starting area, a plurality of color card slots for holding color cards, a fish card slot for holding fish cards, a playing card draw slot for holding unplayed playing cards, a playing card discard slot for holding discarded playing cards and a dice bubble for containing and randomly rolling a pair of dice;

(b) a plurality of fish cards, each said fish card designating a fish, for identifying a player's target fish and enhancing points associated with that fish on color cards;

(c) a plurality of colored color cards, each said color card having a plurality of bait designator, fish and point combinations and each said color card having a fish and point combination not associated with a bait designator;

(d) a plurality of bait boards for assignment to players, each said bait board having a plurality of labeled grouped baits, each said bait within said grouped baits being associated with a bait designator for associating the bait with fish and point combinations on the color cards and each said bait within said grouped baits being associated with a bait selector for selecting the bait on the bait board;

(e) a plurality of playing cards comprising:

(i) sequential fishing cards for catching a fish designated on a color card;

(ii) a plurality of specialty cards comprising:

(1) a plurality of game warden cards for impairing an opponent's ability to accumulate points;

(2) a plurality of fishing license cards for neutralizing the game warden cards;

(3) a plurality of bonus bait cards for permitting a player to select an additional bait on the bait board assigned to that player;

(4) a plurality of bogus bait cards for inhibiting an opponent's ability to select baits within a bait group on the opponent's assigned bait board; and (iii) a plurality of snag cards for impairing an opponent's ability to catch a fish by playing the sequential fishing cards;

(f) a plurality of game pieces for designating each player's position on the game board; and (g) a pair of dice enclosed within the dice bubble for determining the number of fishing points to be traversed by a player and for generating random numbers.

6. The fishing board game of claim 5, wherein the sequential fishing cards are comprised of cast cards, bite cards, hook cards, fight cards and caught cards.

7. The fishing board game of claim 5, wherein the fish associated with each bait designator, fish and point combination on the color cards of each color is selected from a group of fish having similar desirability and preferred foods.

8. The fishing board game of claim 6, wherein the fish associated with each bait designator, fish and point combination on the color cards of each color is selected from a group of fish having similar desirability and preferred foods.

9. The fishing board game of claim 5, wherein the game board has an aquatic background.

10. The fishing board game of claim 6, wherein the game board has an aquatic background.

11. The fishing board game of claim 7, wherein the game board has an aquatic background.

12. The fishing board game of claim 8, wherein the game board has an aquatic background.

* * * * *